US006296131B2

(12) United States Patent
Rashid

(10) Patent No.: US 6,296,131 B2
(45) Date of Patent: Oct. 2, 2001

(54) PLASTIC CONTAINER WITH HORIZONTAL ANNULAR RIBS

(75) Inventor: A. B. M. Bazlur Rashid, Neenah, WI (US)

(73) Assignee: Pechiney Emballage Flexible Europe (FR)

( * ) Notice: Subject to any disclaimer, the term of this patent is extended or adjusted under 35 U.S.C. 154(b) by 0 days.

(21) Appl. No.: 09/783,470

(22) Filed: Feb. 14, 2001

Related U.S. Application Data

(63) Continuation of application No. 09/373,496, filed on Aug. 12, 1999, now Pat. No. 6,230,912.

(51) Int. Cl.[7] ..... B65D 1/02; B65D 1/44
(52) U.S. Cl. ..... 215/383; 215/382; 220/672
(58) Field of Search ..... 215/382, 383; 220/672, 675

(56) References Cited

U.S. PATENT DOCUMENTS

| | | | |
|---|---|---|---|
| D. 103,496 | 3/1937 | Funkey . | |
| D. 105,808 | 8/1937 | Schein . | |
| D. 112,798 | 1/1939 | Watson . | |
| D. 112,799 | 1/1939 | Watson . | |
| D. 112,800 | 1/1939 | Watson . | |
| D. 218,019 | 7/1970 | Lattraye et al. . | |
| D. 268,324 | 3/1983 | Gautier . | |
| D. 275,267 | 8/1984 | Gautier . | |
| D. 300,511 | 4/1989 | Cramer . | |
| D. 329,868 | 9/1992 | Sakaguchi et al. . | |
| D. 331,881 | 12/1992 | Garver et al. . | |
| D. 339,068 | 9/1993 | Bell et al. . | |
| D. 342,674 | 12/1993 | Schollen et al. . | |
| D. 347,391 | 5/1994 | Guertin . | |
| D. 348,006 | 6/1994 | Feen . | |
| D. 348,007 | 6/1994 | Feen . | |
| D. 348,837 | 7/1994 | Feen . | |
| D. 351,341 | 10/1994 | Hung . | |
| D. 356,037 | 3/1995 | Jury . | |
| D. 359,237 | 6/1995 | Nakamura . | |
| D. 370,178 | 5/1996 | Petre et al. . | |
| D. 375,462 | 11/1996 | David . | |
| D. 379,306 | 5/1997 | Peykoff . | |
| D. 386,088 | 11/1997 | Satoh . | |
| D. 398,539 | 9/1998 | Guislain . | |
| D. 400,794 | 11/1998 | Takeuchi et al. . | |
| D. 401,860 | 12/1998 | Granelli . | |
| D. 403,243 | 12/1998 | Takeuchi et al. . | |
| D. 404,306 | 1/1999 | Steinke . | |
| D. 409,493 | 5/1999 | Waggaman et al. . | |
| D. 411,750 | 6/1999 | Forecast et al. . | |
| D. 411,803 | 7/1999 | Guertin . | |
| 2,685,316 * | 8/1954 | Krasno | 220/672 |
| 3,225,950 | 12/1965 | Josephsen et al. . | |
| 3,297,194 | 1/1967 | Schaper et al. . | |
| 3,397,724 | 8/1968 | Bolen et al. . | |
| 3,403,804 | 10/1968 | Colombo . | |
| 4,497,855 | 2/1985 | Agrawal et al. . | |
| 4,610,366 | 9/1986 | Estes et al. . | |
| 4,818,575 | 4/1989 | Hirata et al. . | |
| 5,024,341 | 6/1991 | Dekerle . | |

(List continued on next page.)

FOREIGN PATENT DOCUMENTS

| | | |
|---|---|---|
| 189987 | 5/1957 | (AT) . |

*Primary Examiner*—Sue A. Weaver
(74) *Attorney, Agent, or Firm*—McDermott, Will & Emery

(57) ABSTRACT

A plastic bottle comprises a label panel portion comprising a plurality of ribs extending annularly about the perimeter thereof and lands located between each rib for accepting a label thereon, wherein the ribs are configured to render the label panel substantially rigid and capable of enduring pasteurization without subjecting the lands to substantial alteration or misalignment. A pasteurizable bottle having a label panel onto which a label may be evenly secured is thus provided.

22 Claims, 2 Drawing Sheets

U.S. PATENT DOCUMENTS 5,067,622 11/1991 Graver et al. .
5,632,397 5/1997 Fandeux et al. .
5,690,244 11/1997 Darr .
5,704,504 1/1998 Bueno .
5,746,339 5/1998 Petre et al. .
5,908,128 6/1999 Krishnakumar et al. .

* cited by examiner

PLASTIC CONTAINER WITH HORIZONTAL ANNULAR RIBS

This application is a continuation of U.S. patent application Ser. No. 09/373,496 filed on Aug. 12, 1999 U.S. Pat. No. 6,230,912.

BACKGROUND OF THE INVENTION

1. Field of the Invention

The present invention relates generally to plastic containers; particularly to plastic containers designed to hold liquids under pressure during pasteurization or other thermal treatment.

2. Background Art

Bottles of various configurations and materials have long been employed for the distribution of liquids by the beverage industry. Although the beverage industry traditionally employed glass containers to deliver liquid beverages to customers, that industry has recently embraced the use of plastic bottles due to the relative cost advantages and durability of plastics. For reasons of efficiency and to lower production costs, the plastic container industry has embraced the conventional technique of blow molding plastic containers from plastic preforms. Polyethylene terephthalate ("PET") or polypropylene ("PP") are typically used to construct plastic containers because of, among other reasons, the ability to reclaim and recycle containers constructed therefrom. A barrier layer constructed, for example from ethylene vinyl alcohol ("EVOH"), is sometimes employed with the PET or PP to inhibit the migration of gases such as oxygen and carbon dioxide as well as moisture into or out of, the container.

Although plastic has proven more durable than glass in many aspects, plastic containers may be subject to deformation, in instances in which glass was not, due to the relative strength of thicker glass bottles over the thinner plastic bottles. Sanitation requires that beverages be at least partially sterilized prior to reaching the consumer. Typically this is accomplished by elevating the beverage to a predetermined temperature for a specified period of time in order to kill all objectionable organisms without major chemical alteration of the beverage. The two currently accepted methods for accomplishing such sterilization are hot-filling and pasteurization. Hot-filling entails heating the beverage to the required temperature for the required period of time prior to bottling the beverage. The bottles are then filled and sealed while the beverage remains at an elevated temperature sufficient to assure that living objectionable organisms on the container surfaces are rendered harmless. As the beverage cools from the sterilizing temperature, the internal pressure of the bottle drops and creates a pressure differential with the surrounding environment which is sustained until the bottle is opened by the consumer. Thus, hot-filled bottles often deform inwardly as a result of the pressure differential. This deformation is often referred to as "paneling." Alternatively, the beverage may be sterilized after filling, often referred to in the industry as "pasteurization" and will likewise be so referenced herein. Pasteurzation entails filling each bottle with unsterilized beverage and sealing the bottle. The bottle and its contents are then raised to the desired temperature for the desired period of time in order to kill all objectionable organisms without major chemical alteration of the beverage. Because the beverage is sealed prior to pasteurization, no objectionable organism from the surrounding environment may infiltrate the beverage. The sterility of the beverage is thus guaranteed. The internal pressure of the bottle is substantially elevated with respect to that of the surrounding environment as the pasteurization process heats the beverage in the sealed bottle. This pressure differential may result in outward deformation of the bottle. Although the internal pressure of the bottle typically returns to the pre-pasteurization level, the bottle may retain some deformation experienced during pasteurization.

Prior plastic bottle configurations have attempted to overcome the deformation caused by hot-filling and pasteurization by simply increasing the overall wall thickness of the bottle. The resulting costs and manufacturing difficulties experienced with these configurations rendered them commercially unacceptable. Other bottle configurations have employed various ribs or panels about the bottle in an attempt to elevate its resistance to deformation. However, these configurations created difficulties with properly placing a label on the bottle and the complicated nature of these bottle configurations often rendered the bottle prohibitively costly.

Specific configurations of the bottle base have been constructed to prevent base deformation which may cause the bottle to be unstable when rested upright on its base. One such base configuration can be found in co-pending U.S. patent application Ser. No. 09/172,345 which is hereby incorporated herein by reference in its entirety.

Bottles intended to undergo hot-filling rather than pasteurization are usually designed to absorb the pressure differential that is created by the cooling of the beverage subsequent to sealing the bottle. This pressure absorption is often accomplished by placing "vacuum panels" in the sidewall of a hot-fill bottle. Thus, aesthetic features of hot-fill bottle configurations anticipate, and are designed to accommodate, change resulting from the sterilization process.

Conversely, bottles intended for pasteurization are not designed to anticipate aesthetic changes resulting from the sterilization process. Rather, because the bottle deformation that results from the internal pressure created by pasteurzation subsides once the beverage cools, bottles intended for pasteurization may be molded with the same aesthetic features that will be viewed by the final consumers. Thus, permanent deformation is especially undesirable for bottles intended to undergo pasteurization rather than hot-filling. Permanent deformation resulting from pasteurization is not anticipated. Thus, deformation of pasteurizable bottles should be prevented or, at least, maintained within the elastic zone of deformation for the material from which the bottle is constructed.

SUMMARY OF THE INVENTION

It is one of the principal objectives of the present invention to provide a plastic bottle having a high resistance to deformation due to hot-filling or sterilization.

It is another objective of the present invention to provide a plastic bottle comprising annular ribs which provide resistance to both longitudinal and radial bottle deformation.

It is another objective of the present invention to provide a plastic bottle comprising annular ribs which provide resistance to deformation without requiring excessive wall thickness.

It is another objective of the present invention to provide a plastic bottle comprising annular ribs which have a predetermined depth to width ratio to provide resistance to both longitudinal and radial bottle deformation.

It is another objective of the present invention to provide a plastic bottle that is cost effective and will resist both longitudinal and radial deformation.

It is still another objective of the present invention to provide a plastic bottle having a high resistance to longitudinal and radial deformation and is capable of being blow molded from a standard preform.

DETAILED DESCRIPTION OF THE DRAWINGS

Figure 1:
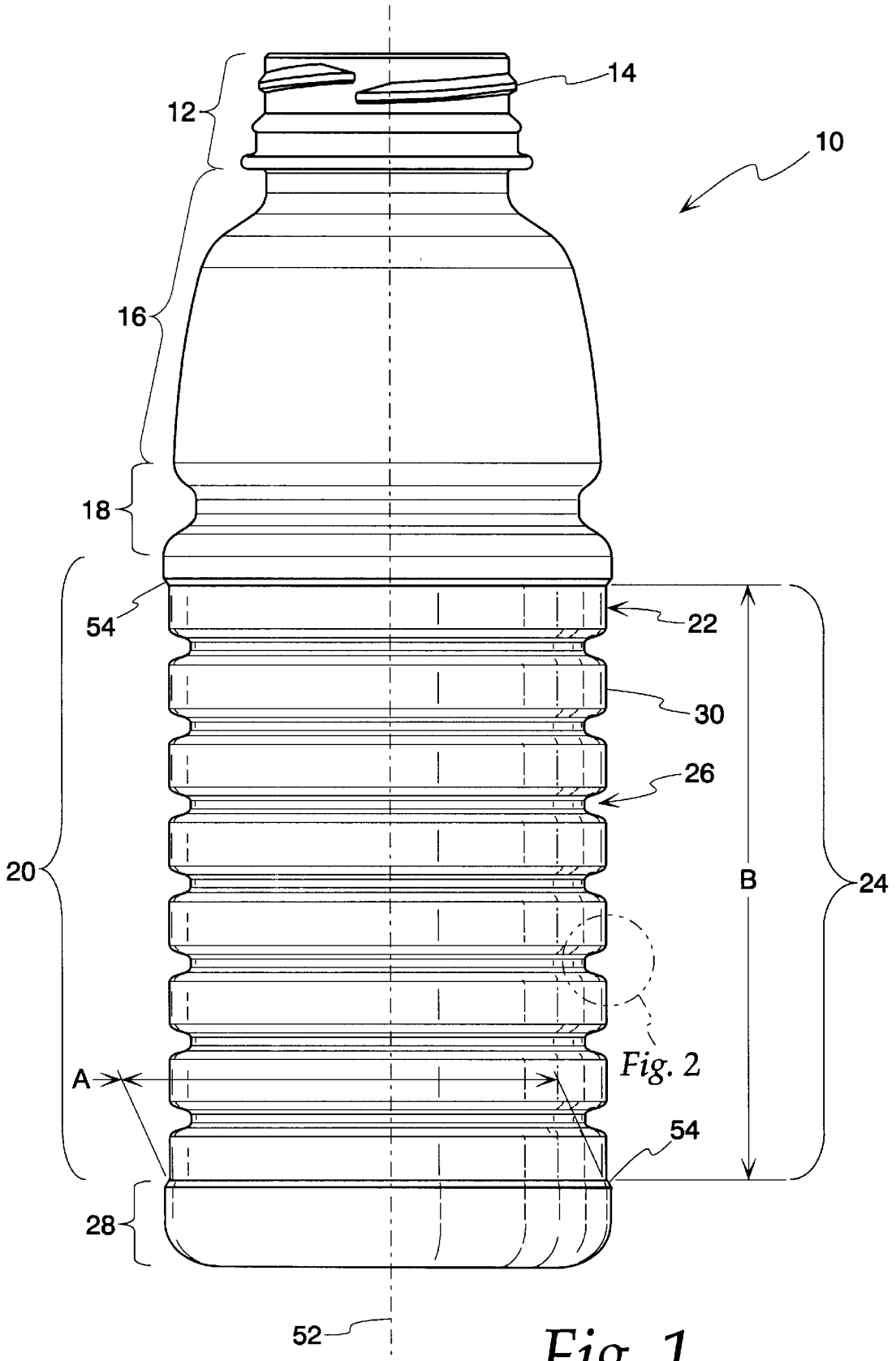
FIG. 1 is a side elevational view of a container according to the present invention.
Figure 3:
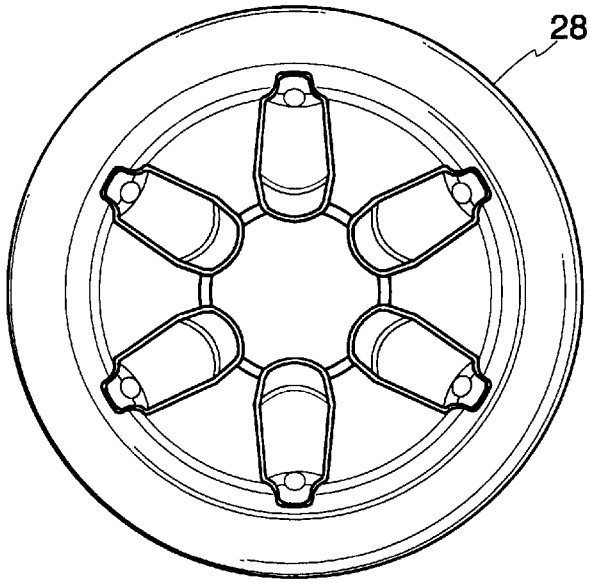
FIG. 3 is a bottom elevational view of the base of the container shown in FIG. 1.

A container according to the present invention is depicted in FIG. 1 in the form of a bottle 10 having a top end 12 with a threaded finish 14 for receiving a thread-on cap (not shown) to seal the bottle 10 after filling with a desired product. A rounded neck portion 16 integrally extends downward and outward from the top end 12 widening to form integrally with an annular groove 18. Annular groove 18 then extends integrally into a body portion 20 of the bottle 10 wherein the body portion 20 comprises a cylindrical wall 22 having a label panel portion 24 with a plurality of annular ribs 26 therein. A single rib 26 is depicted in cross-section in FIG. 2 separated from the remainder of the bottle 10. A base 28 of the bottle 10 extends integrally from, and closes the bottom end of, the body portion 20. The base 28 is depicted in FIG. 3 dissected from the remaining portions of the bottle 10. Preferably, the bottle 10 is formed as an integral unit by blow molding from a standard preform using conventional blow molding techniques.

Figure 2:
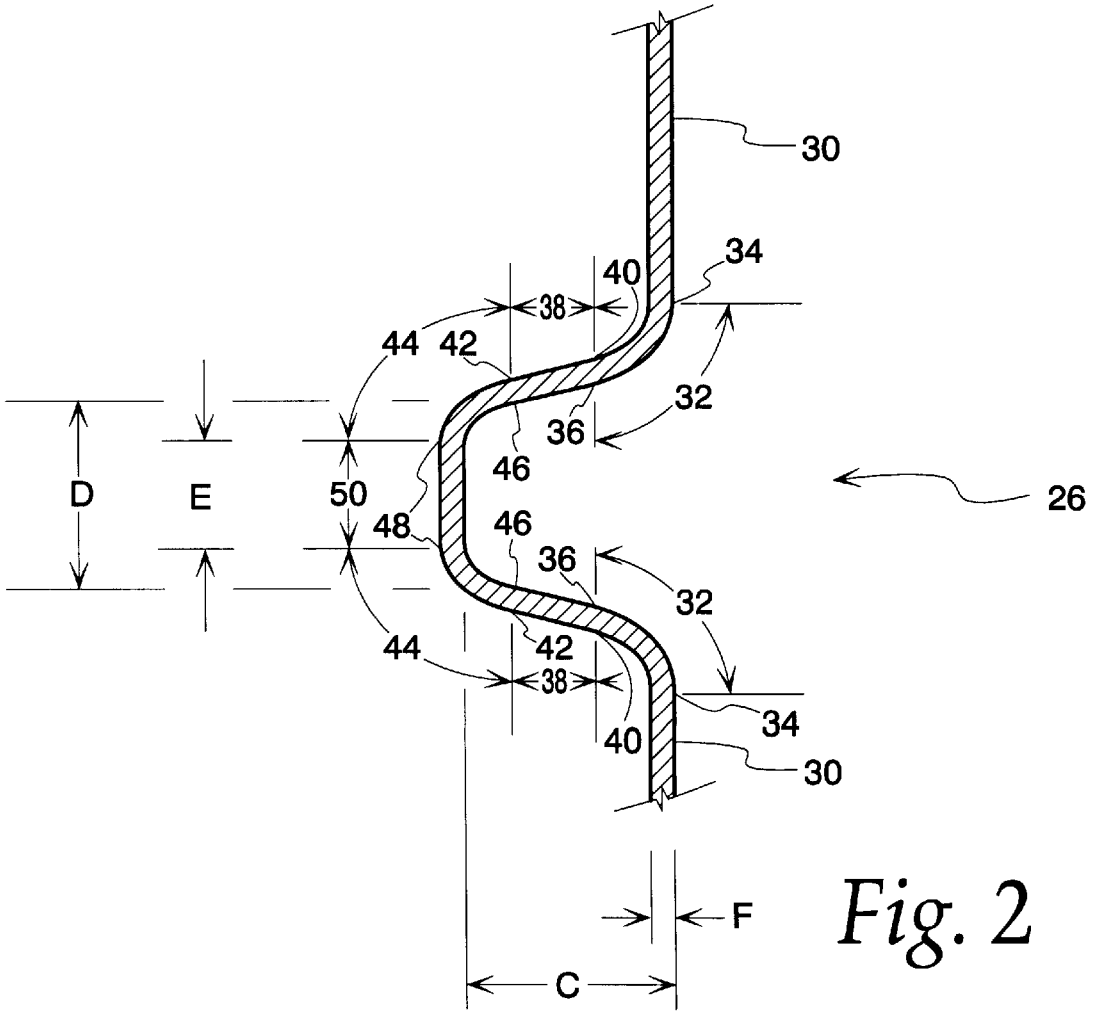
FIG. 2 is a cross sectional view of a single annular rib of the container shown in FIG. 1.

As depicted in FIG. 1, the plurality of annular ribs 26 are each separated one from another by an annular land 30. Each annular rib 26, as depicted in FIG. 2, comprises a pair of opposing outer radii 32, each of which comprises an outer end 34 and an inner end 36. The outer end 34 of each outer radius 32 is contiguous with an adjacent annular land 30 and each outer radius 32 extends inward of the annular land 30. Each annular rib 26 further comprises a pair of opposing straight walls 38 each having an outer end 40 and an inner end 42. The outer end 40 of each straight wall 38 is contiguous with an adjacent one of the outer radius inner ends 36 as depicted in FIG. 2. Each annular rib 26 further comprises a pair of opposing inner radii 44 each having an outer end 46 and an inner end 48 wherein each straight wall inner end 42 is contiguous with an adjacent inner radii outer end 46 as depicted in FIG. 2. Each annular rib 26 further comprises a root wall 50 extending contiguously between the opposing inner radii inner ends 48 to close off the rib 26.

Each rib 26 extends annularly about the cylindrical wall 22 and is oriented substantially perpendicular to a central longitudinal axis 52 of the bottle 10. Furthermore, each land 30 and each root wall 50 are oriented substantially parallel to the bottle central longitudinal axis 52.

As depicted in FIG. 1, and discussed above, the plurality ribs 26 are located within the label panel portion 24 of the bottle 10. The label panel portion 24 is provided with two annular beads 54 for label panel protection, one located at each of the upper and lower ends of the label panel portion 24 to bolster its resistance to radial deformation (often referred to as hoop strain). The label panel portion is configured to provide an area in which the beverage manufacturer may place a label to communicate the contents of the bottle, information required by government regulations and any desired marketing information or materials which may be required to impart the desired image to a consumer. It is important to assure that the label panel provides an even surface that will support a label and will not subject the label to excess damage prior to reaching the ultimate consumer so that the message and image presented by the label is not adversely effected. Bottle configurations that damage a label or the image intended to be imparted thereby, are commercially unacceptable. Therefore, the label panel portion 24 of the present bottle 10 designed to assure that the lands 30 provide an even surface to support a label, even after being subjected to the rigors of pasteurization.

It has been found that the strength of the label panel section 24 may be optimized by providing the ribs with an average depth to width ratio in the approximate range of 1.0:1.0–1.1:1.0. Deformation of the bottle 10 will typically occur either longitudinally along the central longitudinal axis 52 due to longitudinal stresses or radially of the bottle 10 due to radial stresses. Radial stresses resulting from pasteurization are commonly referred to as hoop stress. By dimensioning the ribs 26 in the above range of ratios, the ribs are configured to withstand nearly equal amounts of longitudinal stress and radial stress such that any resulting deformation will likewise be nearly equal. Increasing the length E of the root wall 50 or increasing the radius of curvature of the inner radii 44 to lower the depth to width ratio would expose the ribs 26 to excessive deformation in the form of buckling (inward for hot-filling and outward for pasteurization). The resulting excessive deformation may enter the zone of plastic deformation of the material from which the bottle 10 is constructed and thus result in permanent deformation permanently altering the aesthetic appearance of the bottle 10 regardless of whether the deformation resulted from hot-filling or pasteurization. Lowering the depth to width ratio of the ribs 26 is therefore undesirable.

Conversely, shortening the length E of the root wall 50 or decreasing the radius of curvature of the inner radii 44 to increase the depth to width ratio would result in difficulties of blow molding a parison around the rib portion of the mold as is known in the art. Difficulties would also arise in obtaining a proper release of the bottle from the mold as is also known in the art.

It has also been found that the strength of the label panel portion 24 may be optimized by providing the ribs 26 with an average land 30 width to total rib 26 width ("total rib width" being measured between the outer radii outer ends 34 of a single rib 26) ratio in the range of 1.09:1.0–1.30:1.0. Thus, the length B of the label panel 24 and the size of the ribs 26 will determine the number of ribs 26 in the label panel 24.

Constructing the plurality of ribs 26 and the interspersed lands 30 of the bottle 10 within the above strictures will provide the label panel 24 with a sufficient resistance to deformation such that the lands 30 will remain substantially radially aligned and provide an area onto which a label may be secured. This label area is not substantially altered by the pasteurization process. Moreover, the land width to total rib width ratio discussed above provides ample support to a label to ensure its integrity and allow the information thereon to be easily viewed by consumers without the portions of the label extending between the lands 30 (and thus across the ribs) becoming substantially damages or altered due to normal wear and tear to which a beverage bottle will be subjected.

For example, a bottle according to the present invention was reheat stretch blow molded from PET having a diameter A of 2.832 inches at each land 30 (and thus a circumference of 8.897 inches), a panel portion height B of 7.683 inches, a rib depth C (as measured from the exterior of the land 30 to the exterior of the root wall 50) of 0.120 inches, a rib width D (as measured between the opposing inner radius outer ends 46) of 0.112 inches, a root wall 50 having a length E of 0.050 inches, the inner radii 44 having a radius of curvature of 0.031 inches and running for ninety degrees (90°), the outer radii 32 having a radius of curvature of 0.060 inches and running for ninety degrees (90°) with the straight wall 38 extending at an angle of fifteen degrees (15°) from perpendicular to the central longitudinal axis 52. In this configuration, the depth to width ratio is 1.071:1. The lands 30 are 0.27 inches long, the total rib width is 0.2475 inches and the ribs 26 have a thickness F of 0.015–0.019 inches. The bottle was filled with water and pasteurized at 165° F. for a timer period in the range often (10) to twenty (20) minutes and then left to cool. The bottle exhibited no visible deformation once cooled.

From the foregoing description, it will be apparent that the plastic container of the present invention has a number of advantages, some of which have been described above and others of which are inherent in the bottle 10 of the present invention. Also, it will be understood that modifications can be made to the plastic container of the present invention without departing from the teachings of the invention. Accordingly the scope of the invention is only to be limited as necessitated by the accompanying claims.

I claim:

1. A plastic bottle comprising a cylindrical wall defining a longitudinal axis and a cylindrical wall outer perimeter, the cylindrical wall having a plurality of annular ribs, at least one of the annular ribs having a pair of substantially straight wall portions extending inward of the cylindrical wall outer perimeter, a pair of opposing outer radii extending one each from an outer end of the substantially straight wall portions, a pair of opposing inner radii extending one each from an inner end of the substantially straight wall portion, and a root wall extending between the opposing inner radii.

2. The bottle of claim 1, the at least one of the annular ribs defining a width and a depth and the average ratio of the depth to width of the at least one of the annular ribs is between approximately 1.0:1.0 and 1.1–1.0.

3. The bottle of claim 1 the root wall being substantially straight and defining a root wall radius with respect to the longitudinal axis, the radius of each root wall being substantially equal to the radius of each other root wall.

4. The bottle of claim 1, the cylindrical wall comprising a land located between each pair of adjacent annular ribs, the lands defining the cylindrical wall outer perimeter.

5. The bottle of claim 4, each land defining a width, each annular rib defining a width, the ratio of the width of each land to the width of an adjacent at least one of the annular ribs being between 1.09:1.0 and 1.3:1.0.

6. The bottle of claim 5, each land being substantially straight and defining a radius of the cylindrical wall outer perimeter, the radius of the lands being substantially equal to each other so that the cylindrical wall outer perimeter is of substantially constant diameter.

7. The bottle of claim 4, each land being substantially straight.

8. The bottle of claim 4, each land being substantially parallel to the longitudinal axis.

9. The bottle of claim 8, the lands defining a label panel over which a label may be applied.

10. The bottle of claim 4, each land being substantially straight and defining a radius with respect to the longitudinal axis, the radius of each of the lands being substantially equal to the radius of each of the other lands so that the cylindrical wall outer perimeter is of substantially constant diameter.

11. The bottle of claim 1 being constructed of PET and the cylindrical wall having a thickness of approximately between 0.015 and 0.019 inches.

12. A plastic bottle comprising a cylindrical wall defining a longitudinal axis and a cylindrical wall outer perimeter, the cylindrical wall having a plurality of annular ribs, at least one of the annular ribs having a pair of substantially straight wall portions extending inward of the cylindrical wall outer perimeter and defining an angle of approximately fifteen degrees from perpendicular to the longitudinal axis.

13. A plastic bottle comprising a cylindrical wall defining a longitudinal axis, the cylindrical wall having a plurality of ribs extending annularly about the longitudinal axis, each of the plurality of ribs defining a width, and each of the plurality of ribs being separated from an adjacent one of the plurality of ribs by a land defining a land width, the ratio of the width of at least one land to the width of a rib adjacent to the at least one land being approximately between 1.09:1.0 and 1.3:1.0 and each of the at least one of the plurality of ribs defining a depth, the average ratio of the depth to width of the at least one of the plurality of ribs being approximately between 1.0:1.0 and 1.1:1.0.

14. The bottle of claim 13, at least one of the plurality of ribs comprising a pair of substantially straight wall portions extending inward of an outer perimeter defined by the cylindrical wall.

15. The bottle of claim 13, each land is substantially parallel to the longitudinal axis.

16. The bottle of claim 13, being constructed of PET and the cylindrical wall having a thickness of between 0.015 and 0.019 inches.

17. The bottle of claim 13, each land being substantially straight and defining a radius with respect to the longitudinal axis, the radius of each of the lands being substantially equal to the radius of each of the other lands to define an outer perimeter of the cylindrical wall that is substantially of constant diameter.

18. A plastic bottle comprising a cylindrical wall defining a longitudinal axis, the cylindrical wall having a plurality of ribs extending annularly about the longitudinal axis, each of the plurality of ribs defining a width, and each of the plurality of ribs being separated from an adjacent one of the plurality of ribs by a land defining a land width, the ratio of the width of at least one land to the width of a rib adjacent to the at least one land being approximately between 1.09:1.0 and 1.3:1.0 and at least one of the plurality of ribs comprising a pair of substantially straight wall portions extending inward of an outer perimeter defined by the cylindrical wall each of the substantially straight wall portions defining an angle of substantially fifteen degrees from perpendicular to the longitudinal axis.

19. A plastic bottle comprising a cylindrical wall defining a longitudinal axis, the cylindrical wall having a plurality of ribs extending annularly about the longitudinal axis, each of the plurality of ribs defining a width, and each of the plurality of ribs being separated from an adjacent one of the plurality of ribs by a land defining a land width, the ratio of the width of at least one land to the width of a rib adjacent to the at least one land being approximately between 1.09:1.0 and 1.3:1.0 and at least one of the plurality of ribs comprising a pair of substantially straight wall portions extending inward of an outer perimeter defined by the cylindrical wall, the at least one of the plurality of ribs further comprising a pair of opposing outer radii one each extending between an adjacent outer land and one of the substantially straight wall portions, a pair of opposing inner radii, one extending from each substantially straight wall portion, and a root wall extending between the opposing inner radii.

20. The bottle of claim 19, the root wall is substantially straight.

21. The bottle of claim 20, the lands comprising a label panel over which a label may be applied.

22. The bottle of claim 19, each root wall being substantially straight and defining a root wall radius with respect to the longitudinal axis, the radius of each root wall being substantially equal to the radius of each other root wall.

* * * * *